US009899736B2

(12) United States Patent
Ho et al.

(10) Patent No.: US 9,899,736 B2
(45) Date of Patent: Feb. 20, 2018

(54) LOW COST ACTIVE ANTENNA SYSTEM

(71) Applicant: Amphenol Corporation, Wallingford, CT (US)

(72) Inventors: Jimmy Ho, Hickory, NC (US); Chengcheng Tang, Kowloon (HK); Jeffrey Sierzenga, Conover, NC (US)

(73) Assignee: Amphenol Corporation, Wallingford, CT (US)

( * ) Notice: Subject to any disclaimer, the term of this patent is extended or adjusted under 35 U.S.C. 154(b) by 283 days.

(21) Appl. No.: 14/784,228

(22) PCT Filed: Apr. 24, 2014

(86) PCT No.: PCT/GB2014/051277

§ 371 (c)(1),
(2) Date: Oct. 13, 2015

(87) PCT Pub. No.: WO2014/174298

PCT Pub. Date: Oct. 30, 2014

(65) Prior Publication Data

US 2016/0049728 A1 Feb. 18, 2016

Related U.S. Application Data

(60) Provisional application No. 61/815,512, filed on Apr. 24, 2013.

(51) Int. Cl.
*H01Q 3/00* (2006.01)
*H01Q 3/36* (2006.01)
(Continued)

(52) U.S. Cl.
CPC ..... *H01Q 3/36* (2013.01); *H01Q 3/26* (2013.01); *H01Q 3/38* (2013.01); *H01Q 3/28* (2013.01); *H01Q 21/22* (2013.01)

(58) Field of Classification Search
CPC .. H01Q 3/26; H01Q 3/28; H01Q 3/36; H01Q 3/38
(Continued)

(56) References Cited

U.S. PATENT DOCUMENTS 3,710,329 A * 1/1973 Mailloux ..... H01Q 3/42 342/373
4,213,133 A * 7/1980 Hidaka ..... H01Q 3/26 342/350
(Continued)

FOREIGN PATENT DOCUMENTS

WO 2012097862 A1 7/2012
WO 2013018365 A1 2/2013

OTHER PUBLICATIONS

International Search Report and Written Opinion for corresponding PCT Application No. PCT/GB2014/051277, dated Jul. 28, 2014 (12 pgs.).
(Continued)

*Primary Examiner* — Chuong P Nguyen
(74) *Attorney, Agent, or Firm* — Shumaker & Sieffert, P.A.

(57) ABSTRACT

An antenna array comprising at least three radiating elements arranged in sequence, wherein alternate radiating elements have feeds configured for direct feeding from output ports of corresponding radio frequency transmitters, and wherein each radiating element situated between a pair of directly-connected elements has a feed coupled to the feeds of the adjacent directly-fed elements.

14 Claims, 11 Drawing Sheets

(51) Int. Cl.

| | |
|---|---|
| ***H01Q 3/26*** | (2006.01) |
| ***H01Q 3/38*** | (2006.01) |
| *H01Q 3/28* | (2006.01) |
| *H01Q 21/22* | (2006.01) |

(58) Field of Classification Search
USPC ..... 342/372, 445
See application file for complete search history.

(56) References Cited

U.S. PATENT DOCUMENTS

| | | | | |
|---|---|---|---|---|
| 6,650,290 | B1 * | 11/2003 | Chang | H01Q 3/26 342/368 |
| 8,558,749 | B2 * | 10/2013 | Meharry | H01Q 3/24 343/816 |
| 2009/0237312 | A1 * | 9/2009 | Schober | H01Q 1/002 343/703 |
| 2013/0308722 | A1 * | 11/2013 | Nilsson | H01Q 3/28 375/295 |
| 2015/0318876 | A1 * | 11/2015 | Resnati | H01Q 1/246 370/297 |

OTHER PUBLICATIONS

"Antenna Engineering Handbook," 2007, Mcgraw Hill, XP002727224, Chapters 20 and 21, (66 pgs.).

* cited by examiner

Relative currents:

| Tilt angle | 0 | 10 | 20 |
|---|---|---|---|
| $I_0$ | 0.5∠0 | 0.5∠0 | 0.5∠0 |
| $I_1$ | 0.7∠0 | 0.7∠-48 | 0.7∠-95 |
| $I_2$ | 1.0∠0 | 1.0∠-96 | 1.0∠-190 |
| $I_3$ | 0.7∠0 | 0.7∠-144 | 0.7∠-280 |
| $I_4$ | 0.5∠0 | 0.5∠-192 | 0.5∠-380 |

All angles are stated in degrees

Relative currents:

| Tilt angle | 0 | 10 | 20 |
|---|---|---|---|
| $I_0$ | 0.5∠0 | 0.5∠0 | 0.5∠0 |
| $I_1$ | 0.7∠0 | 0.7∠-48 | 0.7∠-95 |
| $I_2$ | 1.0∠0 | 1.0∠-96 | 1.0∠-190 |
| $I_3$ | 0.7∠0 | 0.7∠-144 | 0.7∠-285 |
| $I_4$ | 0.5∠0 | 0.5∠-192 | 0.5∠-380 |

LOW COST ACTIVE ANTENNA SYSTEM

This application is a national stage application under 35 U.S.C. § 371 of PCT Application No. PCT/GB2014/051277, filed Apr. 24, 2014, which claims the benefit of U.S. Application No. 61/815,512, filed Apr. 24, 2013. The entire contents of each of PCT Application No. PCT/GB2014/051277 and U.S. Application No. 61/815,512 are incorporated herein by reference in their entirety.

This invention relates to active antenna arrays and, in particular, provides a simple method of reducing the number of active components and cost without sacrificing performance.

BACKGROUND

In modern radio networks, an important tool for the efficient use of the radio spectrum is the careful control of the radiation patterns of base station antennas in both the azimuth and elevation planes. The radiation pattern of an antenna array is characterized by a main beam and subsidiary beams known as sidelobes. The main beam is arranged to illuminate the desired coverage area. The main beam has a defined direction relative to the physical axis of the antenna array and a beamwidth, usually defined as the angle in the azimuth or elevation plane between points having a radiation intensity of one half the maximum intensity. The subsidiary beams or sidelobes may cause interference to the service provided by other base stations and must therefore be reduced in magnitude to mitigate such interference.

An active phased antenna array comprises a plurality of radiating elements wherein each radiating element is connected to radio transmitters and/or receivers. The connection to each radiating element may include phase shifting circuitry to allow the direction and shape of the radiation pattern of the array to be varied by means of analog or digital control signals. This technology has been employed for military uses in the past but more recently is being employed for mobile radio base stations, providing a means by which the coverage and capacity of a network may be increased. However, the acceptance of this technology has been restricted by the high cost of radios with beam steering functions. This is at least partly due to the additional cost of providing phase shifting circuitry or other beam-steering circuitry for each individual radiating element.

FIG. 1 shows a prior art N-element phased array in schematic form. In this arrangement the signal contributions from all elements will arrive in phase at a distant point in the direction of the main beam maximum. The direction of the main beam may be varied by the choice of the differential phase shift between adjacent antenna elements. In accordance with the principle of reciprocity, the same differential phase shifts at a given frequency will result in the same main beam direction for both the transmission and reception of radio signals. In the following description specific reference is made to vertical beam steering, but the method herein described may be applied to a vertical array of elements, providing beam steering in the elevation (tilt) plane, or to a horizontal array when steering will be in the azimuth plane. It may also be applied to a planar array in which case beam steering may be applied to both planes.

In addition to applying a linear phase shift to the currents in the elements of the array, the relative amplitudes and relative phases of the currents may be further optimised. For example, the amplitudes of the currents fed to array elements may be arranged in such a manner that the elements near the ends of the array have lower currents than those near the centre of the array. Various methods for achieving this objective are well known (for example, see Chapters 3, 20 and 29 of the Antenna Engineering Handbook, J L Volakis, editor, 4th Edition, McGraw Hill, New York, 2007).

FIG. 2 shows a typical circuit arrangement for the phased array of FIG. 1. Based on the application of equal differential phase shifts for a five-element array, FIG. 3 shows the radiation patterns at 0°, 10° and 20° from the array normal direction. As can be seen, for sidelobes within 30° of the main beam, the sidelobes are lower than the value required by mobile operators today in urban areas (typically at least 18 dB below the main beam level). However, this approach is hugely expensive. The electronic phase shifters, good quality mixers and also the transmit modules, which include the main components like power amplifiers (PAs), band pass filters (BPFs), pre-PAs, tuning circuits and heatsinks are very expensive and represent a large proportion of the cost of the array.

An existing method by which the number and cost of active components in an array may be reduced is to group at least some of the elements into subarrays, each typically comprising two elements. In such an arrangement, the differential phase between the members of each subarray is fixed, and is typically optimised for the mean value of the required tilt range. However, such techniques are typically beamtilt-limited because it is only possible to dynamically adjust the relative phases between the subarrays and not within them. As the tilt move towards the extremes of its range, the sidelobe performance degrades considerably because the differential phase shift between adjacent elements of the whole array is not linear.

By way of example, FIG. 4 shows a five element array divided into subarrays comprising 2, 1 and 2 elements respectively. The phase difference between the members of the outer pairs of elements can be optimised for the mid-tilt angle, which in this example is 10°, and accordingly the phase difference is fixed at 44°. However, as the beam is moved away from a tilt of 10° by applying a linear phase shift between the subarrays, the sidelobes become higher. Through the use of this arrangement, the number of costly components (e.g. transmit modules and mixers) has been reduced, but the sidelobe performance, as seen in FIG. 5, is unacceptable in a mobile network, especially in densely populated areas.

BRIEF SUMMARY OF THE DISCLOSURE

Viewed from a first aspect, there is provided an antenna array comprising at least three radiating elements arranged in sequence, wherein alternate radiating elements have feeds configured for direct feeding from output ports of corresponding radio frequency transmitters, and wherein each radiating element situated between a pair of directly-connected elements has a feed coupled to the feeds of the adjacent directly-fed elements.

In this way, the number of radio frequency transmitter modules required in an active phased antenna array can be significantly reduced without significantly compromising radiation pattern performance.

In particular, the number of transmitter (Tx) modules (including, but not restricted to, power amplifiers (PAs), band pass filters (BPFs), pre-power amplifiers (pre-PAs), mixers, tuning circuits and heatsinks) by up to 40% relative to the number required in prior art systems while maintaining the low radiation pattern sidelobe levels required for mobile network operation.

The directly fed elements may be connected to the outputs of at least one radio frequency phase shifting circuit. The phase shifting circuits may provide a variable phase shift under external control, for example by analog means or by digital means.

Each radiating element located between a pair of directly fed elements has power coupled to its feed from the two adjacent element feed lines. The adjacent element feed lines may be fed to a coupling means, the output of which is connected to the radiating element situated between the two directly fed elements.

Viewed from a second aspect, there is provided a three-port vectorial combining arrangement having first and second input ports and an output port, the arrangement further comprising:

a) first and second power dividers respectively connected to the first and second input ports, each configured to provide a defined sample of the input power at a first output and the remainder of the input power at a second output;

b) phase detection circuitry configured to detect a phase difference between the first outputs, respectively, of the first and second power dividers and to output a control signal representative of a phase angle between RF signals applied to the first and second input ports;

c) tunable phase shifter circuitry connected to the second output of at least one of the first and second power dividers, the phase shifter circuitry having a control port to receive the control signal output by the phase detection circuitry such that the phase shift introduced by the tunable phase shifter circuitry is controlled by the control signal, the tunable phase shifter circuitry having at least one output;

d) a power combiner having first and second inputs respectively connected to the second outputs of the first and second power dividers, at least one of the second outputs of the first and second power dividers being routed through the tunable phase shifter circuitry, and an output;

e) a further tunable phase shifter having an input connected to the output of the power combiner and a control port to receive the control signal from the phase detection circuitry, the further tunable phase shifter being configured to output to the output port of the combining arrangement an RF signal having a phase substantially equal to an arithmetic mean of the phases of two RF signals fed to the respective first and second input ports of the combining arrangement.

The control signal output from the phase detection circuitry and provided to the tunable phase shifter circuitry may, in certain embodiments, have the necessary magnitude such that the tunable phase shifter circuitry takes a value equal to the total difference between the input phases from the first and second power dividers, in order to allow the first and second inputs to the power combiner to be added in phase.

The control signal output from the phase detection circuitry may be routed to the control port of the further tunable phase shifter by way of a component configured to scale the output of the phase detection circuitry to a range suitable to enable control of the further tunable phase shifter. The component may be an operational amplifier or a microprocessor, and may be configured to scale the output of the phase detection circuitry in such a way as to cause the further tunable phase shifter to take up a value equal to one half of the difference between the phases of the signals input to the phase detection circuitry.

In certain embodiments:

a) the phase detection circuitry may comprises first and second phase detectors, each having i) a first input connected to the first output, respectively, of the first and second power dividers, ii) a second input connected to a reference oscillator by way of a third power divider; and iii) an output providing a respective control signal representative of the phase angle between RF signals applied to the first and second inputs of the respective phase detector;

b) the tunable phase shifter circuitry may comprise first and second tunable phase shifters, respectively connected to the second outputs of the first and second power dividers, the first and second tunable phase shifters each having a control port connected to the respective outputs of the respective phase detectors such that the phase shifts introduced by the first and second phase shifters are controlled by the respective control signals from the first and second phase detectors, the first and second phase shifters each having an output;

c) the power combiner may have first and second inputs respectively connected to the outputs of the first and second tunable phase shifters, and an output; and d) the further tunable phase shifter may be connected to the outputs of the first and second phase detectors by way of a component configured to combine and scale the respective control signals output by the first and second phase detectors thereby to generate the control signal to cause the further tunable phase shifter to output to the output port of the combining arrangement the RF signal having a phase substantially equal to an arithmetic mean of the phases of two RF signals fed to the respective first and second input ports of the combining arrangement.

The component between the phase detection circuitry and the further tunable phase shifter, by way of which the respective control signals are combined and scaled, may comprise an operational amplifier (for analog control signals) or a microprocessor (for digital control signals). Where a microprocessor is used, it may be programmed with an appropriate digital calculation algorithm.

It will be appreciated that the tunable phase shifting circuitry and the further tunable phase shifter in preferred embodiments will need to operate over a range of different frequencies. As such, wideband phase shifters (i.e. maintaining the same phase shift over a wide frequency band) or transmission line (time delay) phase shifters (where the phase shift is proportional to the frequency) are useful.

The output port of the combining arrangement may be used to feed a radiating element that is disposed between a pair of directly fed radiating elements, the first and second input ports of the combining arrangement being fed from by the feed sources of the respective adjacent directly fed radiating elements.

The antenna array of the first aspect may utilise the combining arrangement of the second aspect to feed the radiating elements between adjacent directly fed radiating elements.

The control signals may be in digital or analog format.

Embodiments of the present invention may operate with traditional analog RF signals, or with digital IQ signals.

BRIEF DESCRIPTION OF THE DRAWINGS

Embodiments of the invention are further described hereinafter with reference to the accompanying drawings, in which.

DETAILED DESCRIPTION

For the purposes of the present disclosure, discussion will be focussed on the transmit (Tx) function of the array. It will be understood that corresponding arrangements may be made for a receiving (Rx) antenna or an antenna having both Tx and Rx functions.

Figure 1:
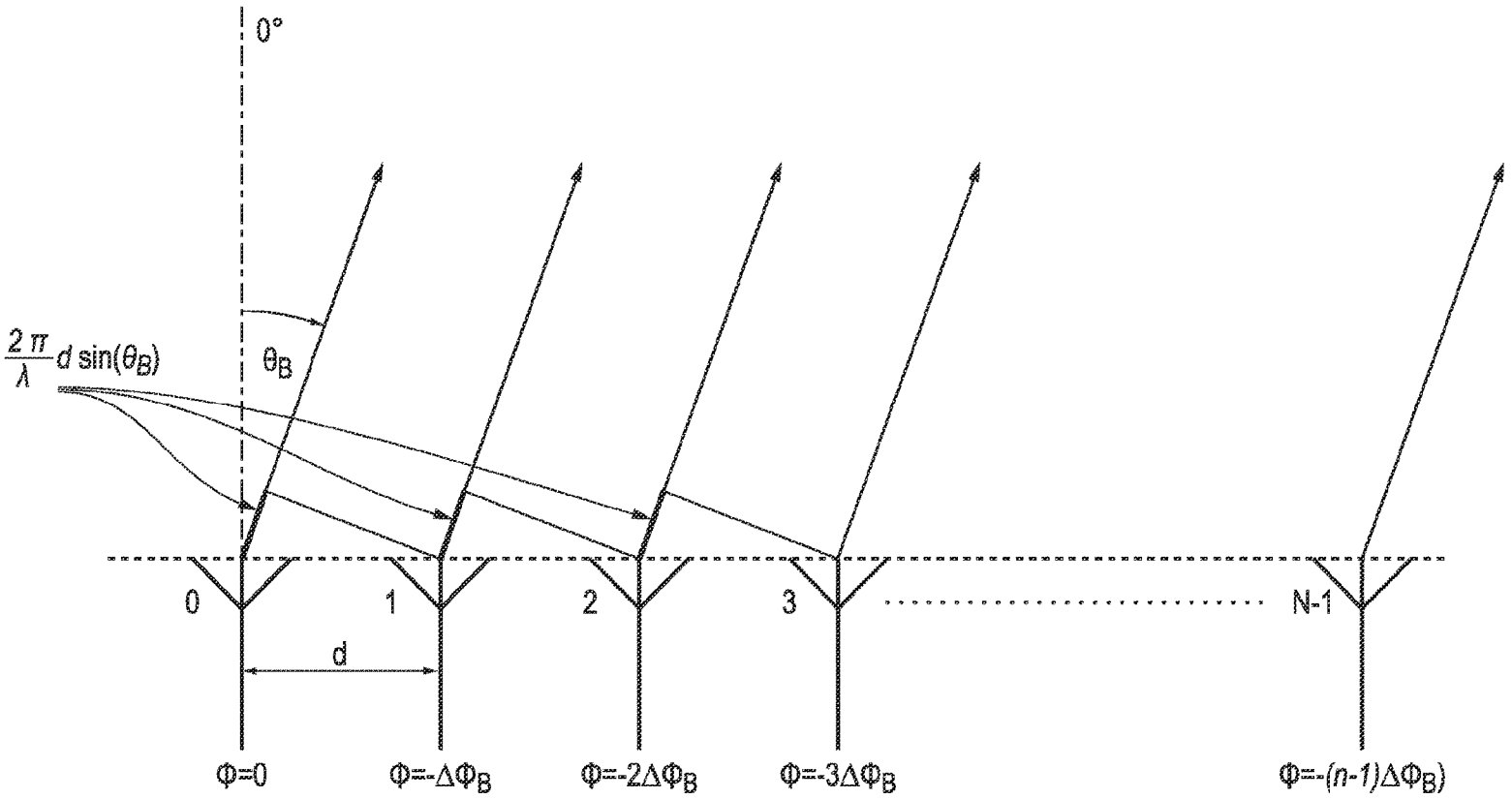
FIG. 1 is a diagrammatic representation of a known broadside array of N elements.

In the conventional linear array of FIG. 1, there are n radiating elements numbered 0 to n−1, each fed with currents having a linear phase progression across the array such that the total phase delay in the feed to the nth element is:

$$\phi_n = -(n-1)\Delta\phi_B$$

where $\phi_B = (2\pi d/\lambda)\sin(\theta_B)$.

Here d is the uniform inter-element spacing, λ is the wavelength and $\theta_B$ is the beam steering angle, measured from the direction normal to the line containing the radiating elements. To steer the main beam to a direction $\theta_B$ from the direction normal to the array in a clockwise direction, the current in each element must be delayed in phase by $(2\pi/\lambda)\sin(\theta_B)$ relative to its neighbour on its left. This results in the signals from all the elements arriving in phase in the desired direction. To steer the main beam in an anticlockwise direction, the phases of the currents are correspondingly advanced in phase.

The spacing d is chosen such that the outer sidelobes, known as grating lobes, remain below acceptable levels for the intended application. Reducing d diminishes the level of the grating lobes but may also reduce the maximum array gain.

Figure 2:
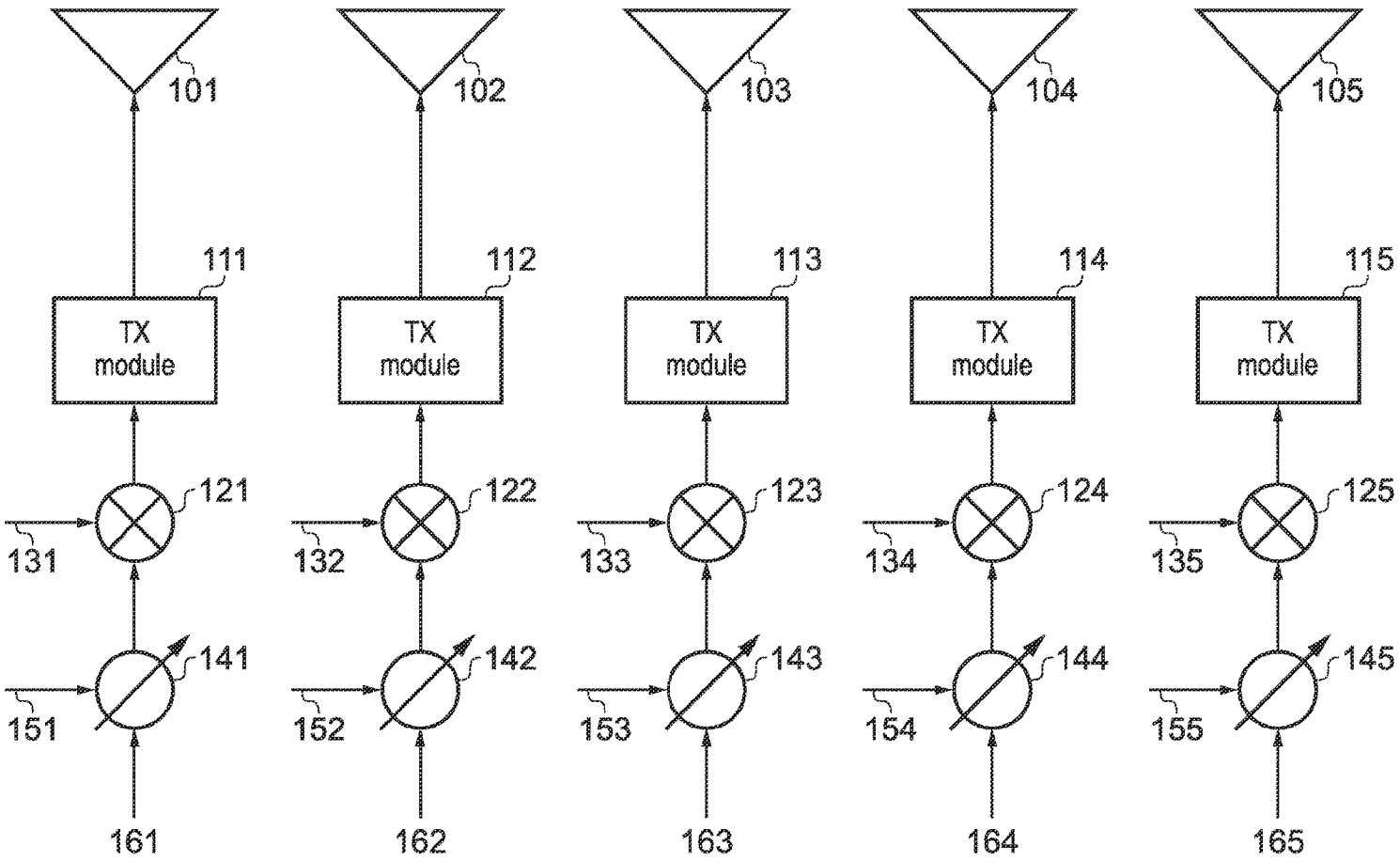
FIG. 2 shows the arrangement of an active phased array according to the prior art.

FIG. 2 shows a schematic representation of a known uniform broadside active phased array of five elements. The array comprises five radiating elements 101 to 105 fed with radio signals by five transmitting modules 111 to 115. Radio signals are applied by input means 161 to 165 through phase shifting means 141 to 145 to mixers 121 to 125. Following mixing with the local oscillator signals applied at input means 131 to 135, the signal at the frequency to be transmitted is applied to the input of each module 111 to 115. The phase shifters 141 to 145 are each provided with control means 151 to 155 which cause the phase shift applied to the radio signal to be varied under the control of a digital or analog control signal.

It will readily be appreciated that the circuit elements associated with each radiating element are similar in function.

Figure 3:
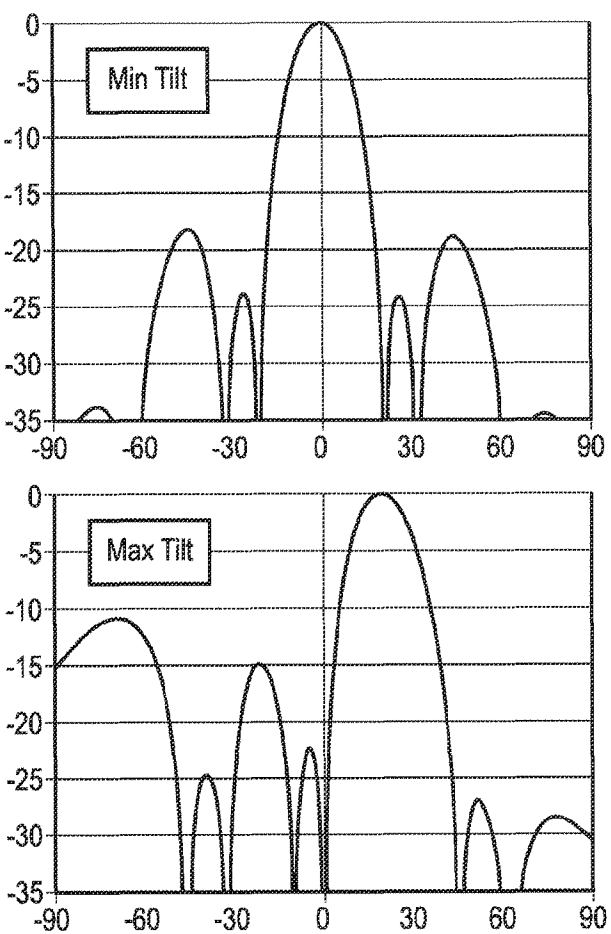
FIG. 3 shows a typical set of radiation patterns for the array of FIG. 2.
Figure 3:
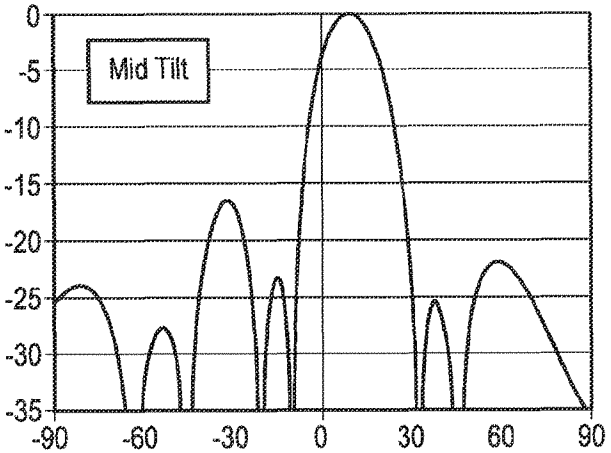

FIG. 3 shows the element currents and computed radiation patterns for the array of FIG. 2 for beam steering angles of 0°, 10° and 20°.

Figure 4:
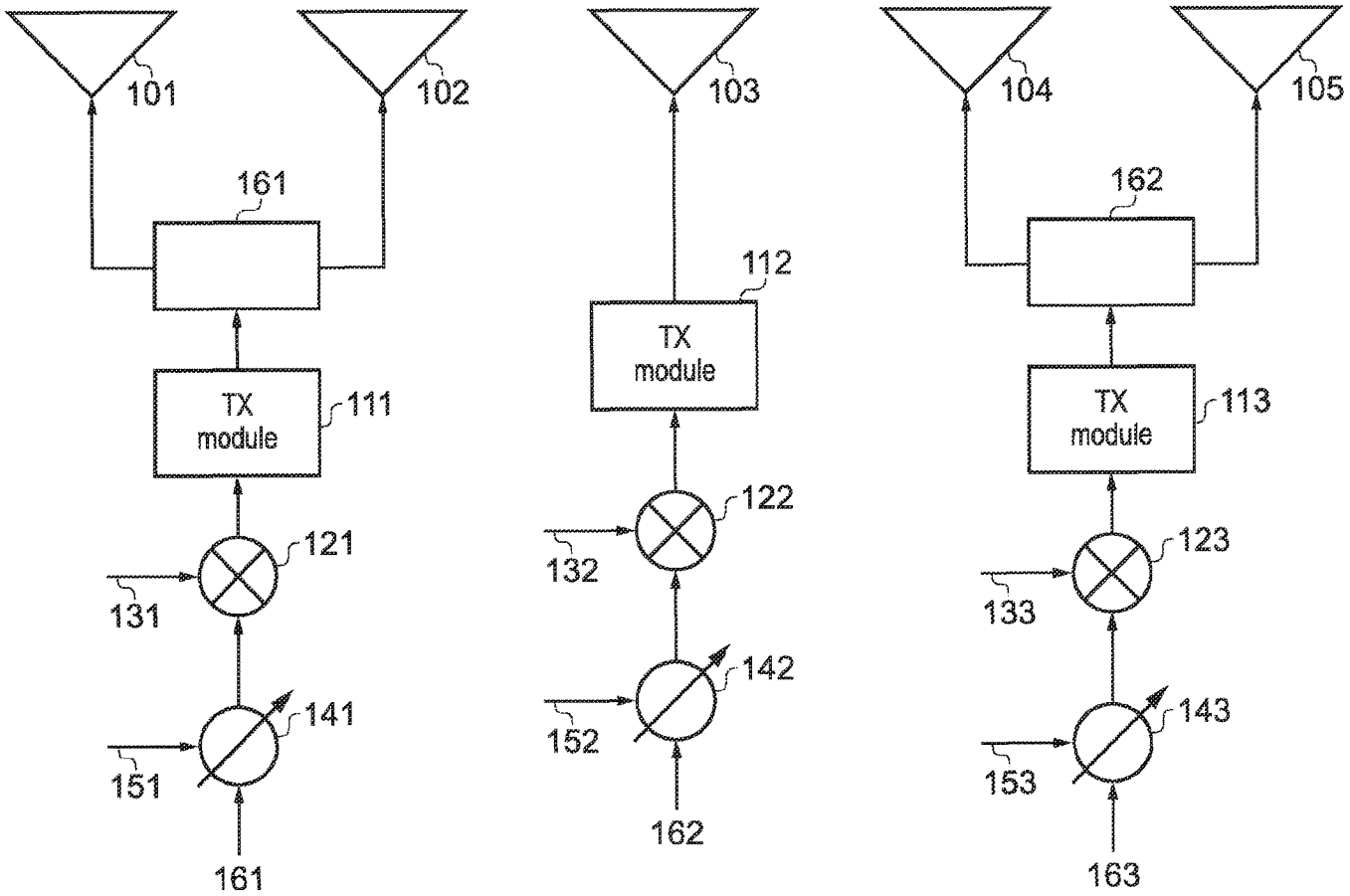
FIG. 4 shows a prior art arrangement in which the outer pair of elements of a 5-element array have been grouped together as subarrays.

FIG. 4 shows a schematic representation of a five-element broadside array fed as two outer subarrays with elements 101, 102 and 104, 105 fed from power dividers 161, 162 respectively. The power dividers 161, 162 and the central element 103 are excited by means of Tx modules 111, 112, 113. The arrangements for feeding the Tx modules 111, 112, 113 are similar to those shown in FIG. 2, with radio signal input means 161, 162, 163, phase shifters 141, 142, 143, control means 151, 152, 153, mixers 121, 122, 123 and local oscillator input means 131, 132 133. It will be seen that in this arrangement only three Tx modules and associated hardware are required to drive the five-element array, but there is no means whereby the relative phase of the currents in elements 101 and 102 or the relative phase of the currents in elements 104 and 105 may be adjusted other than by choice of the lengths of the transmission lines by which they are connected to their respective power dividers 161, 162.

Figure 5:
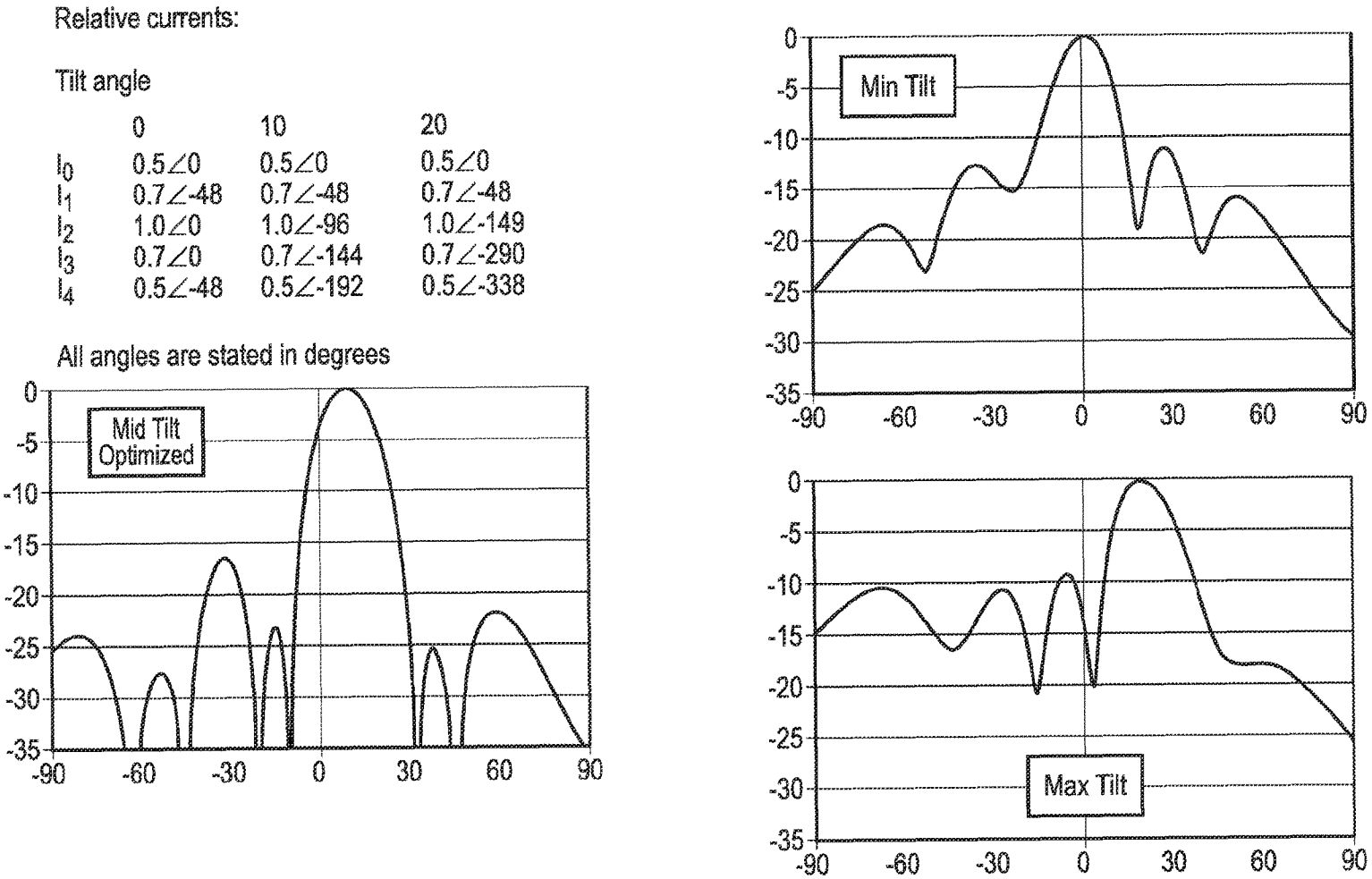
FIG. 5 shows a typical set of radiation patterns for the array of FIG. 4.

FIG. 5 shows the element currents and computed radiation patterns for the array of FIG. 4 for beam steering angles of 0°, 10° and 20°. It will be seen that the radiation patterns at a 10° steering angle are very similar to those of the full array shown in FIG. 3, but at steering angles of 0° and 20° the sidelobe levels are significantly higher and are unacceptable for use in mobile radio networks in dense urban areas.

The radiation pattern F(θ) of a broadside array of N antenna elements is given by:

$$F(\theta) = \sum_{i=0}^{N-1} a_i e^{ji\left(\frac{2\pi}{\lambda} d\sin\theta \cdot \Delta\phi_B\right)} \tag{1}$$

where $$\Delta\phi_B = \frac{2\pi}{\lambda} d\sin\theta_B,$$

and $\theta_B$ is the direction of the main beam, which can be derived when |F(θ)| gets its maximum value from:

$$\sin\theta_B = \frac{\lambda}{2\pi d}\Delta\phi_B \tag{2}$$

or $$\theta_B = \arcsin\left(\frac{\lambda}{2\pi d}\Delta\phi_B\right)$$

From equation (1) it can be seen that the phase of the second element is the average of the phases of the two adjacent elements (e.g. the first and the third element) providing the required linear progressive phase difference ΔØB.

Figure 6:
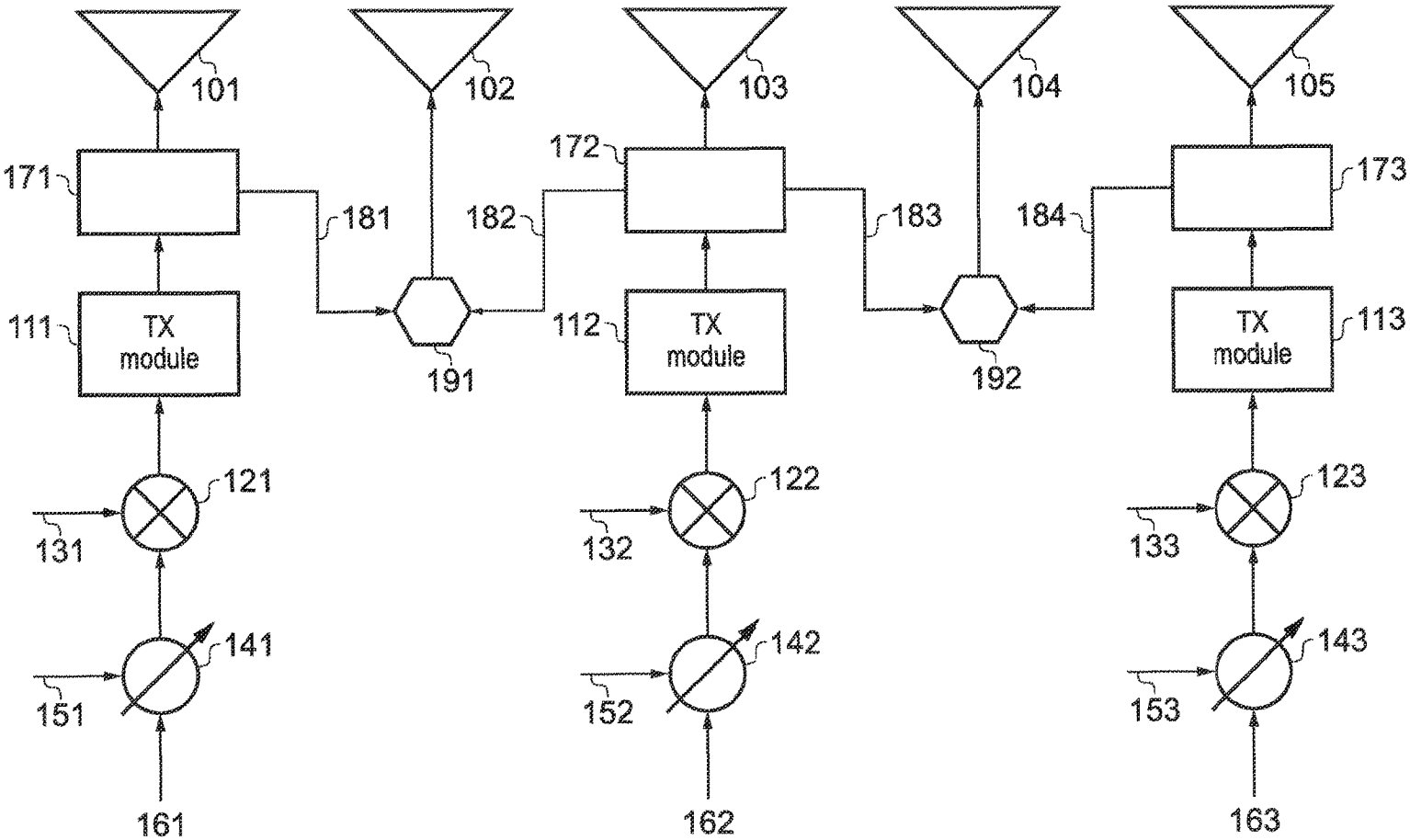
FIG. 6 shows an antenna array of an embodiment of the present invention.

Applying this concept, a simple mathematical summation or averaging device is inserted between two phase shifting control elements as shown in FIG. 6. The expensive Tx modules, which include but are not restricted to mixers, PAs, pre-PAs, heatsinks, BPFs and tuning circuits for improved VSWR performance are not required for alternate elements.

FIG. 6 shows a schematic representation of a five-element broadside array configured according to an embodiment of the present invention. In this arrangement, radio signals are applied by input means 161-163 through phase shifting means 141-143 provided with analog or digital control means 151-153 to mixers 121-123. Following mixing with the local oscillator signals applied at input means 131-133, the signal at the frequency to be transmitted is applied to the input of the modules 111-113.

The outputs of the Tx modules 111-113 are each applied to the input of power dividers 171-173, whose function is to apply a defined fraction of the power applied to them to the vectorial combiners 191, 192 by way of interconnecting transmission lines 181-184 and the remainder of the input power to the radiating elements 101, 103, 105. Outputs of the combiners 191 and 192 are fed to the radiating elements 102 and 104 respectively. By suitable choice of the relative amplitudes of the output levels from each Tx module 111-113 and the choice of the division ratio of the power dividers 171-173, it is possible to achieve a suitable weighting of the element currents to achieve the required degree of sidelobe suppression.

Figure 7:
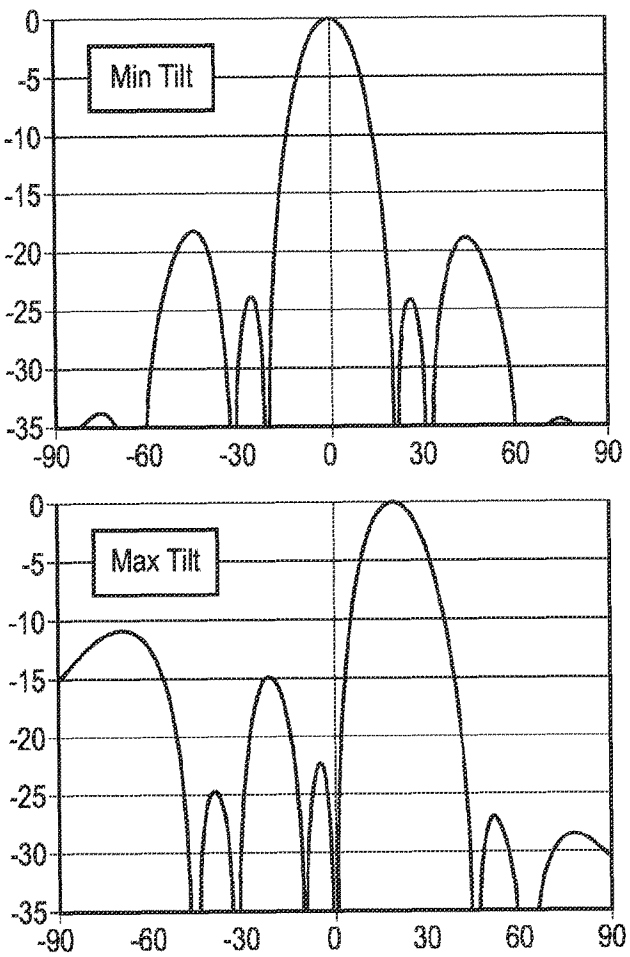
FIG. 7 shows a typical set of radiation patterns for the array of FIG. 6.
Figure 7:
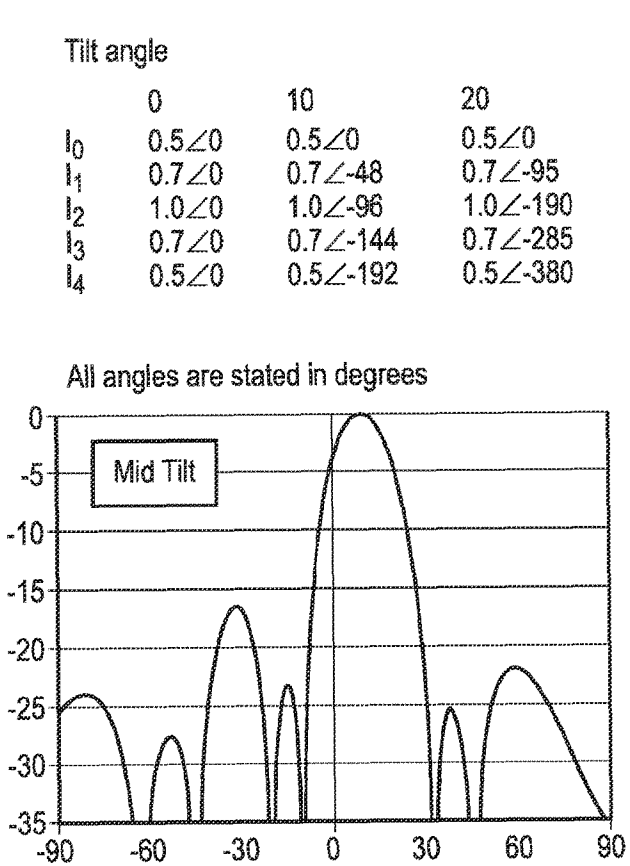

The architecture of the arrangement of FIG. 6 is similar to that of a paired element array (FIG. 4) to reduce components and costs, but without the performance degradation. The vectorial combiner or averaging device has the same effect as if a full phase shifter, transmit module and mixer were in line with the radiating element fed thereby, as can be seen from FIG. 7, which shows the element currents and computed radiation patterns for the array of FIG. 6 for beam steering angles of 0°, 10° and 20°.

Figure 8:
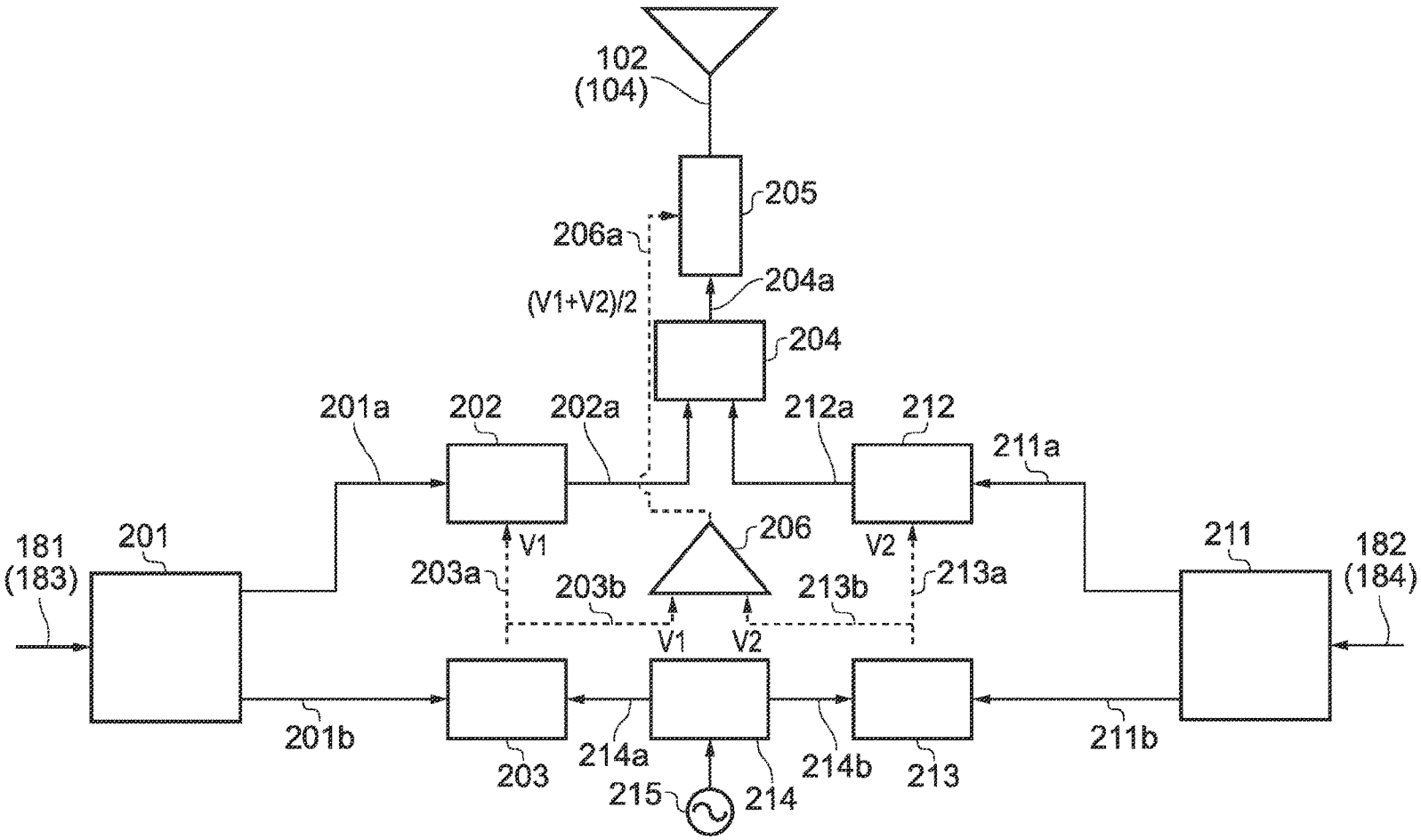
FIG. 8 shows a first exemplary embodiment of the vectorial combiners shown in FIG. 6.

FIG. 8 shows an exemplary arrangement of each of the vectorial combiners 191, 192. The function of each combiner is to combine the inputs of two radio frequency signals and to output a signal whose amplitude is the sum of the two inputs and whose phase is the mean of the phases of the two input signals.

In FIG. 8 the input signals are applied via connecting means 181(183) and 182(184) to the inputs of respective power dividers 201, 211 whose function is to provide a low-level sample signal to the phase detectors 203, 213 by way of connecting means 201*b*, 211*b*. The signal to the second input of each of said phase detectors 203, 213 is obtained via connecting means 214*a*, 214*b* from a reference oscillator 215 via a power splitter 214. The outputs of the phase detectors 203, 213, containing the required phase information, are fed to the control ports of tunable phase shifters 202, 212 via connecting means 203*a*, 213*a*. The other outputs of the power dividers 201, 211, representing the remainder of the input signals applied at 181(183) and 182(184) is passed to the inputs of respective phase shifters 202 and 212 by way of connections 201*a*, 212*a*. The phase shifters 202, 212 are adjusted in response to the input signals at their control ports in such a manner as to bring the two signals presented to the power combiner 204 via connecting means 202*a*, 212*a* in phase with one another before they are combined. The output from the power combiner 204 is delivered via connecting means 204*a* to a tunable phase shifter 205 whose setting is controlled by the signal provided from the output of the operational amplifier 206 via the connecting means 206*a*. By these means the phase shifter 205 is adjusted such that the phase of the output signal lies mid-way between the phases of the input signals at 181 and 182.

The combiner 192 is configured and operates in the same manner as the combiner 191. It is connected to power dividers 172, 173 via connecting means 183, 184 and its output drives radiating element 104.

The control lines 203*a*, 213*a*, 206*a* may carry signals in analog format, or with appropriate interfaces in an alternative embodiment, in digital format. In a digital implementation the operational amplifier 206 may be replaced by a simple microprocessor.

In a further embodiment the reference signal fed to the power splitter 214 may be derived from one of the input signals 161, 162 or 163.

Figure 9:
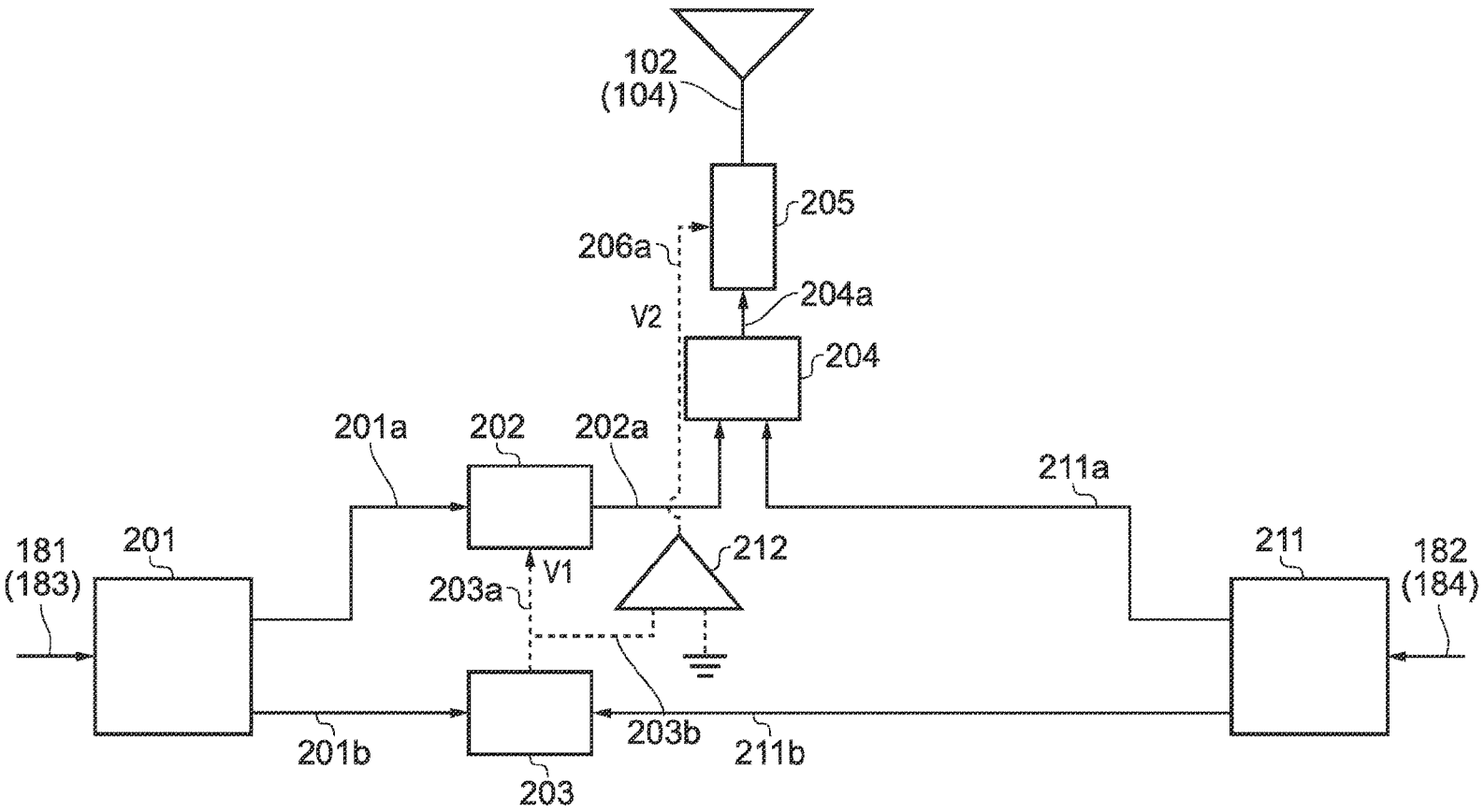
FIG. 9 shows a second exemplary arrangement of the vectorial combiners shown in FIG. 6.

FIG. 9 shows a further embodiment in which a phase detector 203 having inputs 201*b* and 211*b* is connected to the sample ports of power dividers 201 and 211 respectively. The main output from power divider 201 is connected via connecting means 201*a* to tunable phase shifter 202 and thence by connecting means 202*a* to a first input of a power combiner 204. The main output of power divider 211 is connected directly via connecting means 211*a* to a second input of the power combiner 204. The output control signal from the phase detector 203 is applied to the control port of the tunable phase shifter 202 by connecting means 203*a*. The phase shift applied by the tunable phase shifter 202 is adjusted in response to the input control signal to ensure that the inputs 202*a*, 211*a* to the power combiner 204 are in phase.

Connecting means 203*b* carries the output control signal from the phase detector 203 to an input of an operational amplifier 212. The signal is scaled by the amplifier 212 and applied to the control port of the tunable phase shifter 205 by way of connecting means 206*a*. The phase of the tunable phase shifter 205 is adjusted in response to the input control signal to a value equal to one half of the phase shift applied by the phase shifter 202. It will be understood that the total phase shifts associated with the radio paths from the inputs 181(183) and 182(184) to the input 204*a* of the tunable phase shifter 205 must be equal and must be such that the currents in the radiating element 102(104) are cophased with those of the remaining elements of the complete array when the applied input signals at 181(183) and 182(184) are cophased.

Figure 10:
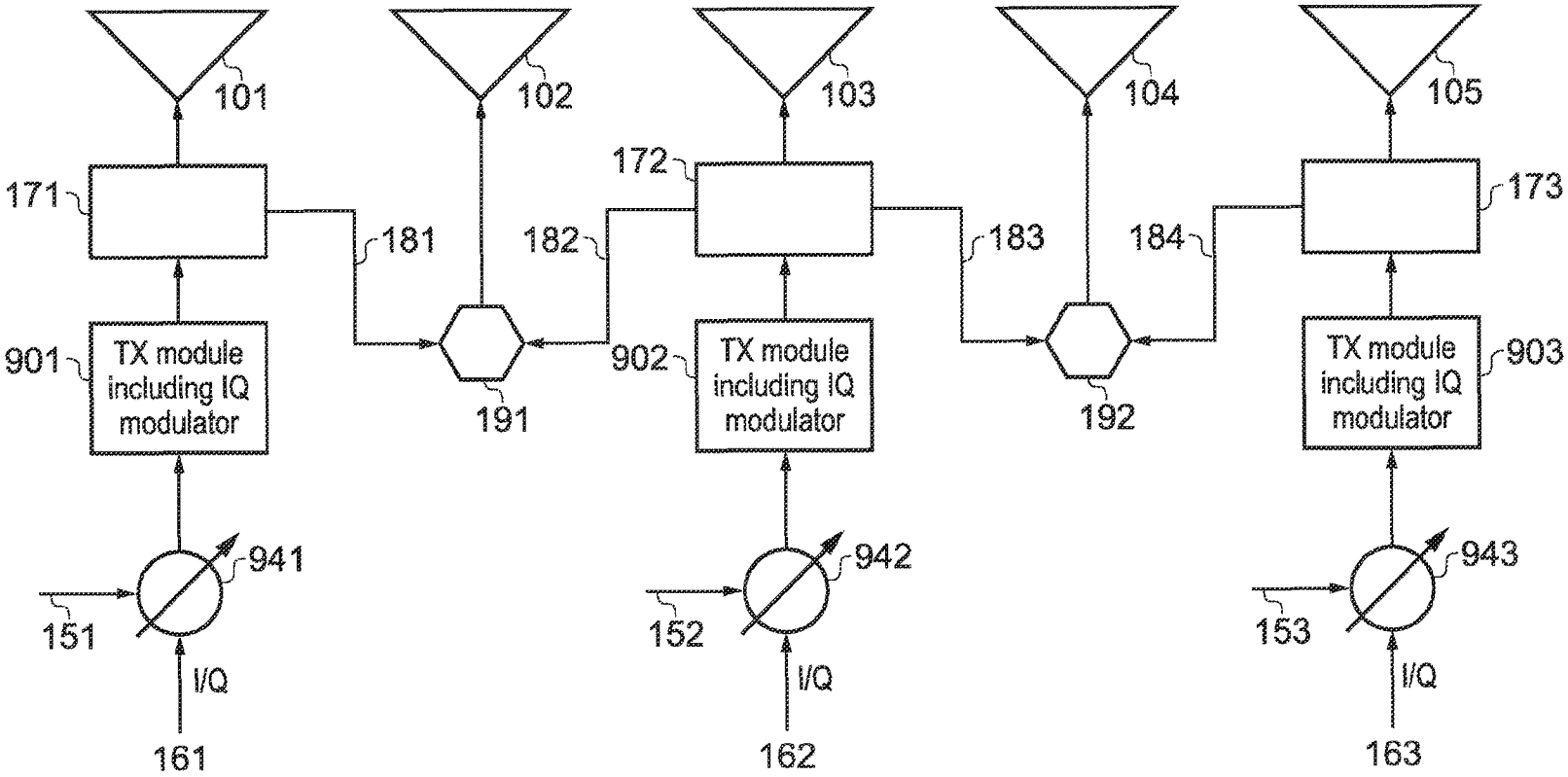
FIG. 10 shows an example of an arrangement using digital IQ signals to the Tx modules.

FIG. 10 shows an alternative arrangement to that of FIG. 6, configured for operation with digital IQ radio signals. In such an arrangement, the Tx modules 901, 902, 903 accept digital IQ input signals and modulate a radio frequency signal which is output to the power dividers 171, 172, 173. Phase shifters 941, 942, 943 operate on the input IQ data streams in such a way as to vary the phase of the radio frequency signal at the output of the Tx modules 901-903 in response to a control signal applied via input means 151, 152, 153. It will be understood that the said phase shifts may be realised by digital means within the Tx modules 901-903.

Figure 11:
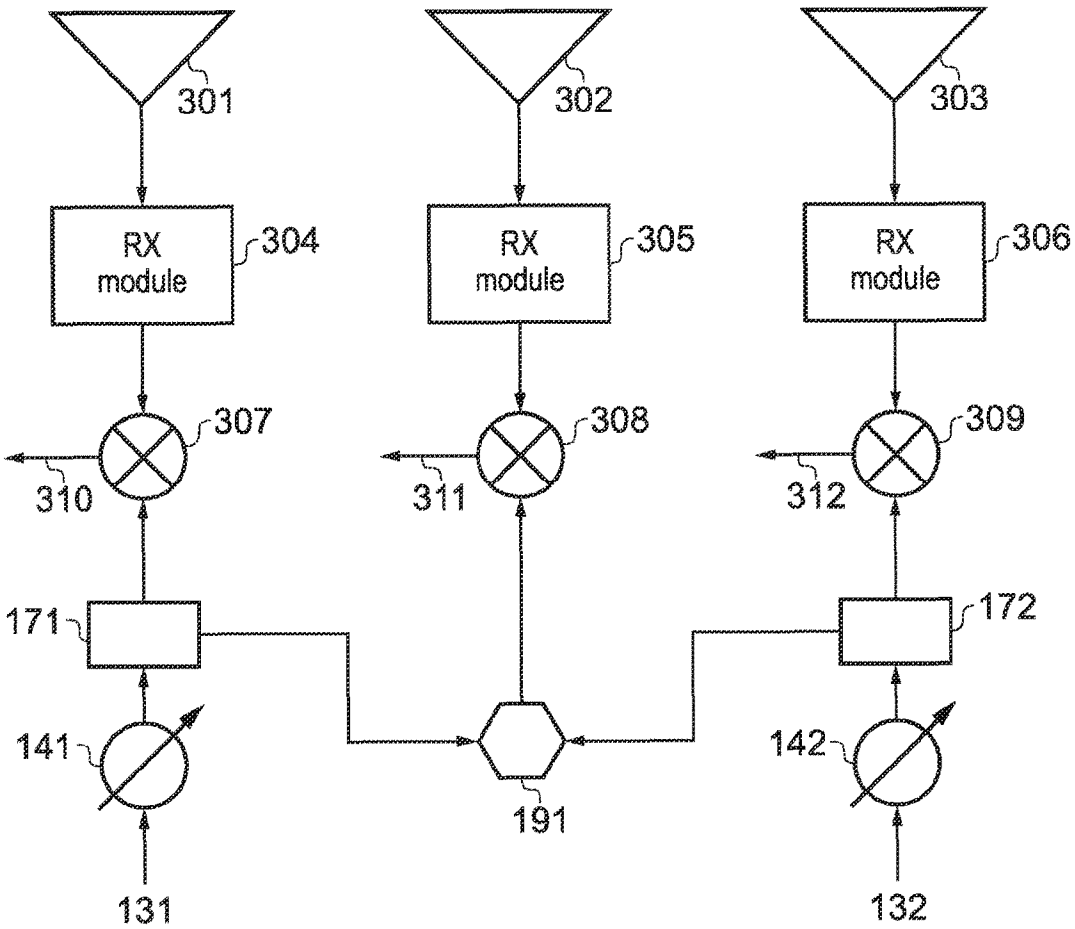
FIG. 11 shows an example of an arrangement configured to receive RF signals.

FIG. 11 shows a receiving antenna array comprising three antenna elements 301, 302, 303 connected to the inputs of three receiver (Rx) modules 304, 305, 306 whose outputs are connected to mixers 307, 308, 309 providing received signal outputs 310, 311, 312. In an exemplary implementation the control of the amplitudes and phases of the received signals is procured by varying the amplitude and phase of local oscillator signals applied to the mixers 307, 308, 309. Accordingly a local oscillator signal is provided at inputs 131, 132 to two phase shifters 141, 142, whose respective outputs are connected to the mixers 307, 308, 309 by means of power dividers 171, 172 and a combining circuit 191 which may be configured in the manner shown in FIG. 8 or 9.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An antenna array comprising at least three radiating elements arranged in sequence, wherein alternate radiating elements have feeds configured for direct feeding from output ports of corresponding radio frequency transmitters, and wherein each radiating element situated between a pair of directly-connected elements has a feed coupled to the feeds of the adjacent directly-fed elements.

2. The array as claimed in claim 1, wherein the directly fed elements are connected to the outputs of at least one radio frequency phase shifting circuit.

3. The array as claimed in claim 2, wherein the phase shifting circuits are configured to provide a variable phase shift under external control.

4. The array as claimed in claim 3, wherein the control is analog control.

5. The array as claimed in claim 3, wherein the control is digital control.

6. The array as claimed in claim 1, wherein each radiating element located between a pair of directly fed elements has power coupled to its feed from the two adjacent element feed lines.

7. The array as claimed in claim 6, wherein the adjacent element feed lines are connected to a combining means the output of which is connected to the radiating element situated between the two directly fed elements.

8. A three-port vectorial combining arrangement having first and second input ports and an output port, the arrangement further comprising:

a) first and second power dividers respectively connected to the first and second input ports, each configured to provide a defined sample of the input power at a first output and the remainder of the input power at a second output;

b) phase detection circuitry configured to detect a phase difference between the first outputs, respectively, of the first and second power dividers and to output a control signal representative of a phase angle between RF signals applied to the first and second input ports;

c) tunable phase shifter circuitry connected to the second output of at least one of the first and second power dividers, the phase shifter circuitry having a control port to receive the control signal output by the phase detection circuitry such that the phase shift introduced by the tunable phase shifter circuitry is controlled by the control signal, the tunable phase shifter circuitry having at least one output;

d) a power combiner having first and second inputs respectively connected to the second outputs of the first and second power dividers, at least one of the second outputs of the first and second power dividers being routed through the tunable phase shifter circuitry, and an output;

e) a further tunable phase shifter having an input connected to the output of the power combiner and a control port to receive the control signal from the phase detection circuitry, the further tunable phase shifter being configured to output to the output port of the combining arrangement an RF signal having a phase substantially equal to an arithmetic mean of the phases of two RF signals fed to the respective first and second input ports of the combining arrangement.

9. The combining arrangement as claimed in claim 8, wherein the control signal output from the phase detection circuitry is routed to the control port of the further tunable phase shifter by way of a component configured to scale the control signal such that the phase of the output of the further tunable phase shifter is substantially equal to the arithmetic mean of the phases of two RF signals fed to the respective first and second input ports of the combining arrangement.

10. The combining arrangement as claimed in claim 8, wherein:

a) the phase detection circuitry comprises first and second phase detectors, each having i) a first input connected to the first output, respectively, of the first and second power dividers, ii) a second input connected to a reference oscillator by way of a third power divider; and iii) an output providing a respective control signal representative of the phase angle between RF signals applied to the first and second inputs of the respective phase detector;

b) the tunable phase shifter circuitry comprises first and second tunable phase shifters, respectively connected to the second outputs of the first and second power dividers, the first and second tunable phase shifters each having a control port connected to the respective outputs of the respective phase detectors such that the phase shifts introduced by the first and second phase shifters are controlled by the respective control signals from the first and second phase detectors, the first and second phase shifters each having an output;

c) the power combiner has first and second inputs respectively connected to the outputs of the first and second tunable phase shifters, and an output; and d) the further tunable phase shifter is connected to the outputs of the first and second phase detectors by way of a component configured to combine and scale the respective control signals output by the first and second phase detectors thereby to generate the control signal to cause the further tunable phase shifter to output to the output port of the combining arrangement the RF signal having a phase substantially equal to an arithmetic mean of the phases of two RF signals fed to the respective first and second input ports of the combining arrangement.

11. The combining arrangement of claim 8, wherein the component between the phase detection circuitry and the further tunable phase shifter, through which the control signal is routed, comprises an operational amplifier.

12. The combining arrangement of claim 8, wherein the component between the phase detection circuitry and the further tunable phase shifter, through which the control signal is routed, comprises a microprocessor.

13. The combining arrangement of claim 8, wherein at least one of the phase shifting circuitry and the further phase shifter comprises wideband phase shifting circuitry.

14. The combining arrangement of claim 8, wherein at least one of the phase shifting circuitry and the further phase shifter comprises transmission line or time delay phase shifting circuitry.

* * * * *